United States Patent [19]

Bellanca

[11] 4,310,326

[45] Jan. 12, 1982

[54] APPARATUS FOR FOLDING PAPER

[76] Inventor: Joseph V. Bellanca, R.D. 2, Muncy, Pa. 17756

[21] Appl. No.: 69,511

[22] Filed: Aug. 23, 1979

[51] Int. Cl.[3] ..... B65H 45/16

[52] U.S. Cl. ..... 493/423; 493/441

[58] Field of Search ..... 493/441, 423, 426, 431, 493/436, 415, 424, 434, 437

[56] References Cited

U.S. PATENT DOCUMENTS 1,672,935 6/1928 Goodwin ..... 493/437

3,309,969 3/1967 Plough ..... 493/441 X 3,762,699 10/1973 Wing ..... 493/434 X 4,221,373 9/1980 Hans ..... 493/423

*Primary Examiner*—Edward M. Coven

*Attorney, Agent, or Firm*—Melvin E. Libby

[57] ABSTRACT

A method and apparatus for sequentially forming folds in a sheet of paper which is continuously moving in a single plane. A first fold is formed in the center of the continuously-moving sheet of paper and subsequent pairs of folds are sequentially formed, one on each side of the previously-formed folds, until the entire continuously-moving sheet is folded. Guide wires retain each folded section until the entire sheet is folded.

6 Claims, 7 Drawing Figures

APPARATUS FOR FOLDING PAPER

BACKGROUND OF THE INVENTION

The present invention relates to a method and apparatus for folding a sheet of paper which is continuously moving in a single plane.

Heretofore it was necessary to momentarily stop the lateral movement of a sheet of paper in order to form a fold. One common type of folding mechanism is a buckle folder wherein the leading edge of the sheet is fed into a pocket causing the adjacent portion to buckle and to be fed into the bite of adjacent folding rolls. Another type of folder is the blade type when the sheet is passed over a pocket and a blade operates to push a portion of the sheet into the pocket to form a fold. In both prior-known types of folding, the forward or feeding motion of the sheet has to be momentarily stopped while the fold is being formed.

SUMMARY AND OBJECTS OF THE INVENTION

The present invention provides a method and apparatus for folding a sheet of paper without interrupting the path of movement and the continuous feeding motion of the sheet. This is important to increase the folding speed of the sheets. Each folded portion of the sheet is retained in its folded position while the additional folds are sequentially formed.

One object of this invention is to form folds in a sheet of paper while the sheet is moving in a predetermined path.

Another object is to sequentially form folds in a sheet of paper which is moving in a predetermined path.

Another object of this invention is to form folds in a sheet of paper at a high speed.

Another object of this invention is to sequentially form folds in a sheet of paper which is continuously moving in a predetermined path and wherein the folded portions are retained in folded position until the entire sheet is folded.

A still further object of this invention is to accurately fold a sheet of paper into sections at a high rate of speed.

DESCRIPTION OF THE PREFERRED EMBODIMENT

Figures 1, 6, 7:
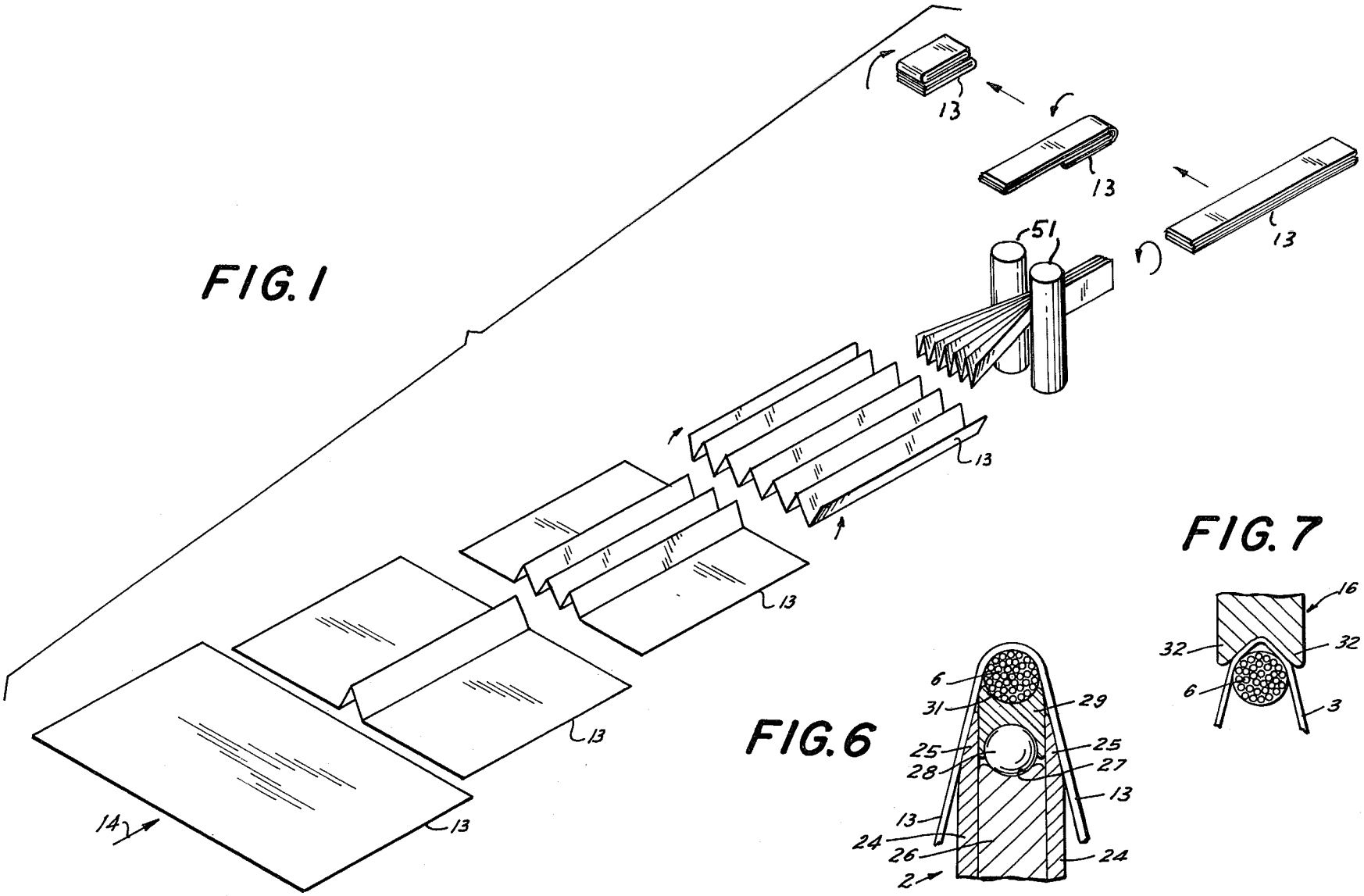
FIG. 1 is a schematic drawing showing the sequential folding of a sheet at four operating stations.
FIG. 6 is an enlarged fragmentary section of folding mechanism pulley and fold wire.
FIG. 7 is an enlarged cross-section showing the interrelationship between the folding wire, the folded portion of sheet and the folding rollers.
Figure 2:
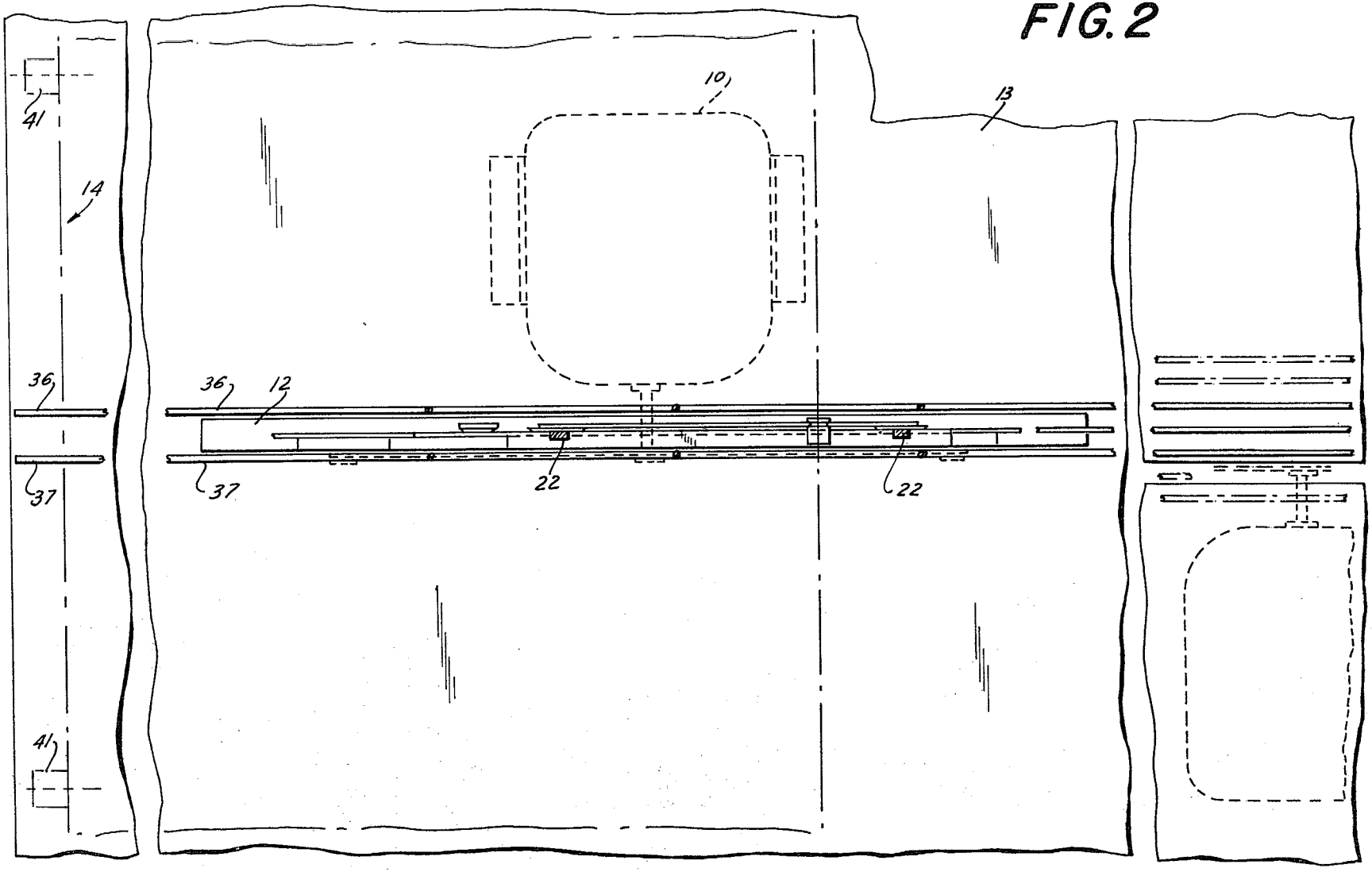
FIG. 2 is a fragmentary top plan view of the folding apparatus taken on lines 2—2 of FIG. 3.

Referring to the drawings, FIG. 1 shows a schematic drawing of the folding operations performed on each sheet of paper fed into the folder. As shown, a sheet of paper is fed flat into the folder and while in motion a first fold is formed in the sheet at station I. The sheet continues to move and while in motion two more folds are formed, one on each side of the first fold at station II. The sheet continues to move and two more folds are formed, one at each end of the previously formed folds at station III. The completely folded sheet is then laid on its side. At this point, as shown, the folded sheet is subjected at station IV to two more folds which are at right angles to the original folds.

Figure 3:
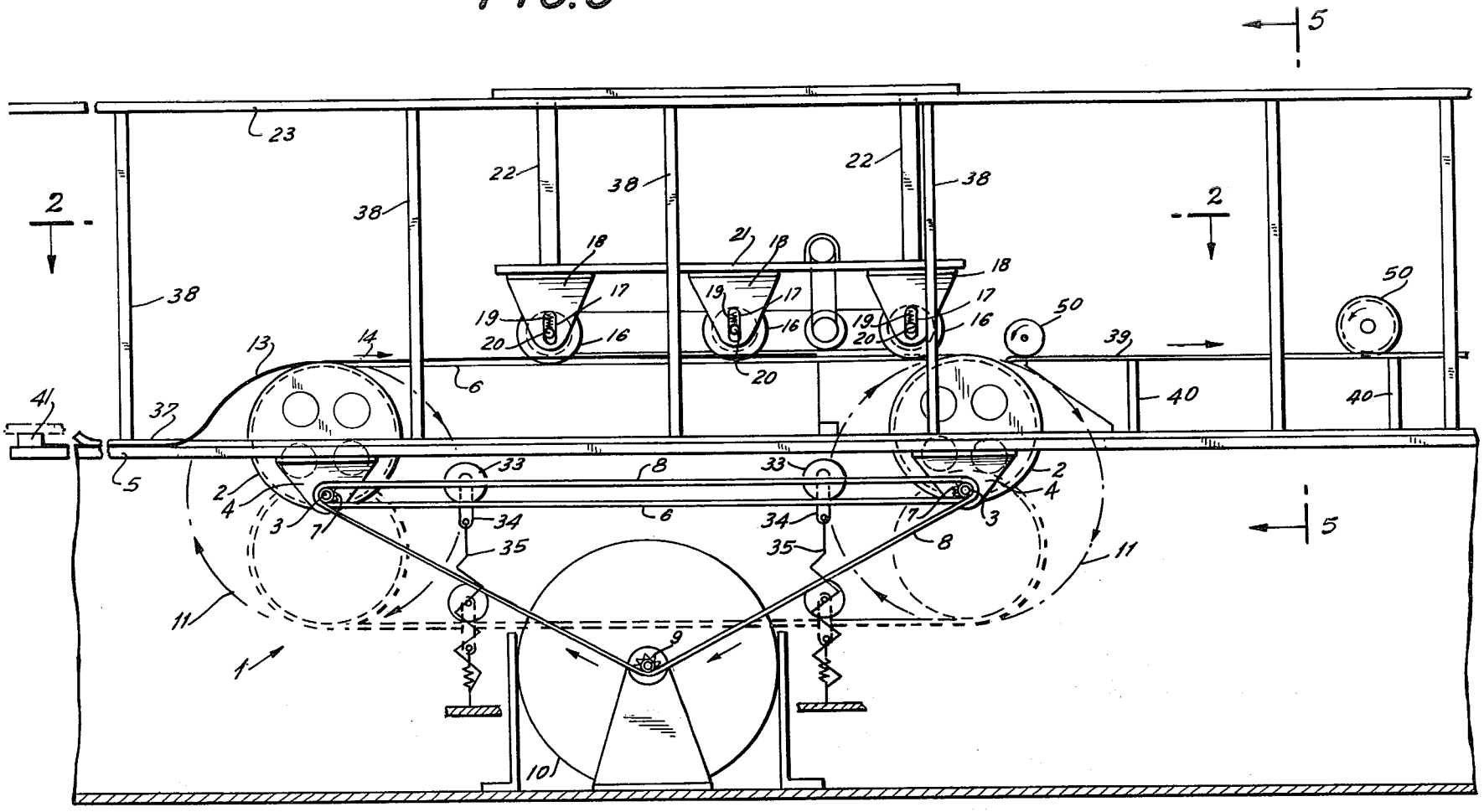
FIG. 3 is a cross-sectional view of the sheet-folding mechanism taken on line 3—3 of FIG. 4.
Figure 4:
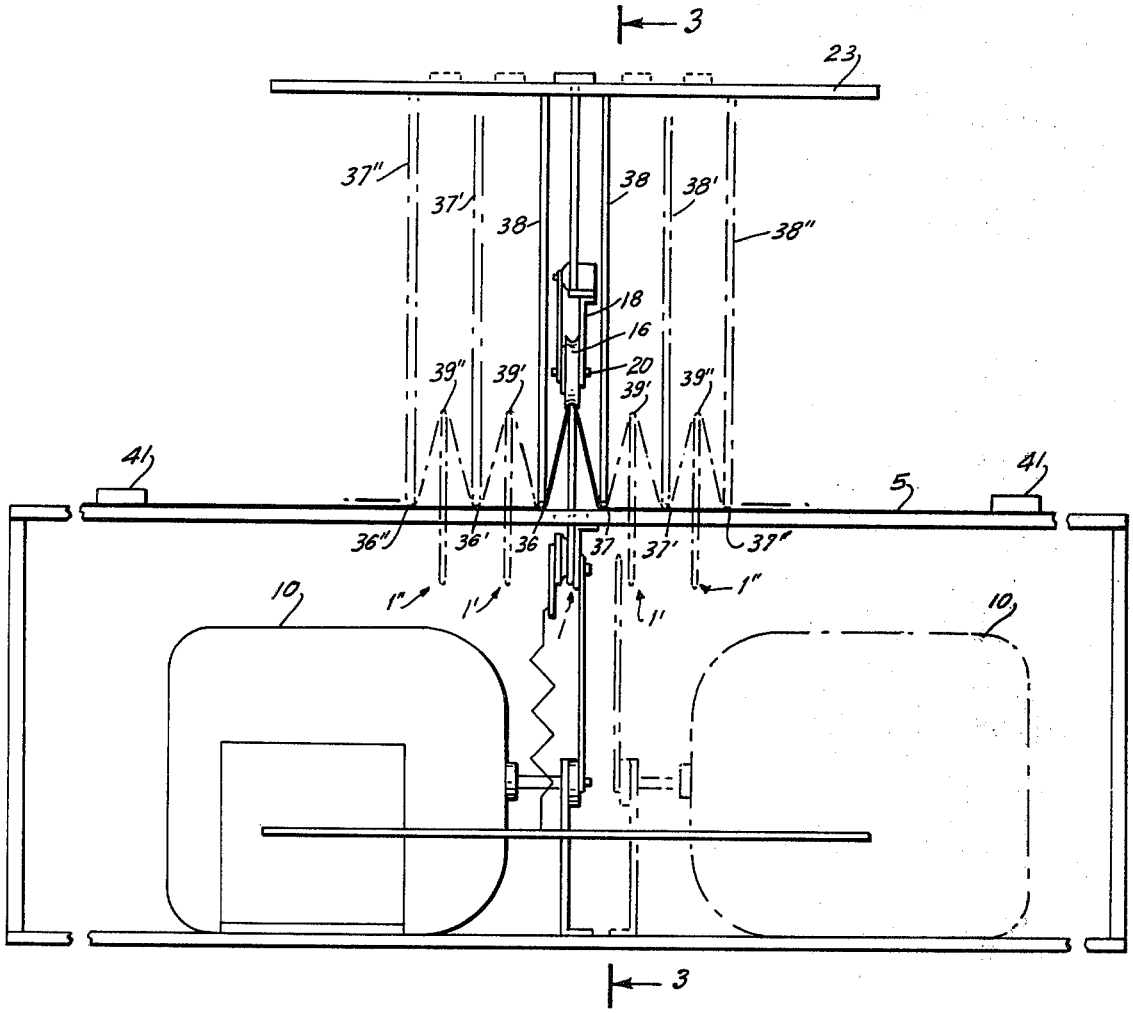
FIG. 4 is an end-elevational view showing Station I in solid lines which is fully illustrated in FIG. 3, and Stations II and III in dotted lines.
Figure 5:
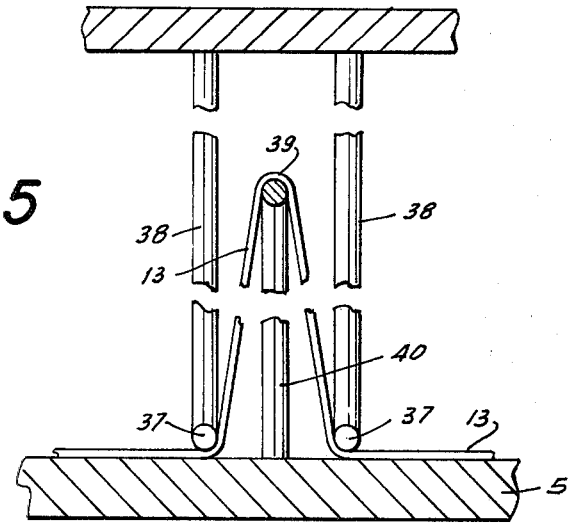
FIG. 5 is an enlarged cross-sectional view taken on line 5—5 of FIG. 3 showing the folded portion of the sheet of paper as it leaves Station I and being retained by guides 36, 37 and fold guide 39.

Referring to the drawings, FIG. 3 shows a side elevation of the novel sheet-folding mechanism 1. This mechanism comprises a pair of spaced-apart pulleys 2 each of which is eccentrically mounted to its respective shaft 3 which in turn is mounted in its respective support 4 each of which is secured to the undersurface of the table top 5. A continuous braided wire 6 tightly extends around and between both pulleys 2. A sprocket 7 is secured to each pulley shaft 3 and a timing belt 8 extends over each sprocket 7 and over a sprocket 9 connected to the drive shaft of a motor 10 mounted to the base of the machine. The sheet-folding mechanism 1, comprising the pulleys 2 and the wire 6, is driven in an elliptical path 11 (shown in dotted lines) by the motor 10.

An opening 12 is formed in the table top 5 having a width and length sufficient to permit the passage of the movement of the folding mechanism 1. In operation the wire 6 contacts the sheet 13 and pulls it upwardly with its movement. Thus the length of the fold formed in the sheet of paper is equal to the distance that the folding mechanism travels above the table top 5. It should be understood that the folding mechanism 1 may be adjustably mounted to the undersurface of the table top 5 so that the distance that it moves above the surface of the table top 5 can be adjusted to form the desired length of the fold to be formed in the sheet.

As shown in FIG. 3, a paper-ejecting mechanism comprises a plurality of driven rollers 16 and an axle 20 for each roller is mounted in a slot 17 formed in a yoke 18 for each roller. A spring 19 is mounted in each slot 17 to retain the axle 20 of each roller 16 under pressure at the bottom of each slot 17. The yokes 18 are secured to a frame 21 which is secured to upwardly-extending supports 22. The upper end of supports 22 are adjustably secured to the upper machine frame 23. The rollers 26 are positioned so that they will contact the wire 6 when the folding mechanism 1 is at the uppermost reach of its elliptical path.

FIG. 6 is an enlarged, fragmentary, cross-sectional view showing the detailed construction of a pulley 2 and a roller 16 and the interaction of the pulley 2, the wire 6, the folded paper 13 and the roller 16 at the time that the folding mechanism is at the uppermost reach of its elliptical movement. As shown, each pulley 2 is constructed of a pair of outer discs 24 with the outer surfaces of the peripheral edge having an inwardly-tapered surface 25 extending to a point. The inner core 26 of the pulley has a diameter smaller than the diameter of the discs 24. The outer edge of the pulley core 26 has a roller bearing raceway 27 for receiving a plurality of roller bearings 28. An outer ring 29 having a roller bearing raceway 30 in its inner surface is positioned to contact the roller bearing 28 and extends slightly beyond the periphery of the disc members 25. The outer surface of ring 29 has a concave surface 31 for receiving the braided wire 6. Thus it can be seen that the wire 6 has a rotational movement about the pulleys 2 independent of and in addition to the elliptical movement that it has as it is carried along with the movement of the eccentrically mounted pulleys 2.

As further shown in FIG. 7, each of the driven rollers 16 are formed having their outer periphery formed into outwardly extending legs 32. It is to be understood that FIG. 7 shows the parts enlarged with the pulley 2 at the uppermost reach of its eccentric movement and the wire 6 in contact with the spring-loaded roller 16 which is rotated at a high speed. At this point the folding mechanism 1 is at its highest point of elliptical movement and the wire 6 has contacted and lifted a portion of sheet 13 away from table 2. Since the high-speed roller 16 is spring loaded, the net effect is to slightly lift the sheet from the wire 6 and to form a slight crease.

Referring to FIG. 3, the solid lines show the folding mechanism at the uppermost reach of its elliptical path. Since the rollers 16 confine the paper between the peripheral surfaces 32 of the rollers 16 and the wire 6 and since the rollers 16 are spring loaded, a downward pressure is applied to the upper reach of wire 6. To assure that the upper reach of wire 6 remains tight, it is desirable to place a wire-tensioning means on the lower reach of the wire 6. This tensioning means takes the form of a pair of grooved pulleys 33 freely rotatably mounted in the upper end of yokes 34. A spring member 35 is secured at one end to the lower end of each yoke 34 and fixed at its lower end to the base of the machine. Thus, as shown in FIG. 3, the solid lines show the springs 35 under maximum tension, and thus exerting maximum tension of wire 6, when the folding mechanism is in the uppermost reach of its elliptical path and under minimum tension when the folding mechanism 1 is at the lowermost reach of its elliptical path as shown in the dotted lines.

It is important to retain the portion of the sheet which is not subjected to the folding action of the folding mechanism in the plane of the table top 5. This is accomplished by providing guide rods 36, 37, one on each side of slot 12 in the table top 5. The guides are retained in a position slightly above table top 5 a distance sufficient to allow free passage of the sheet by means of vertical supports 38 which are adjustably secured at their upper ends to the upper machine frame 23. As the wire 6 of the fold mechanism 1 contacts the sheet 13 and moves the contacted portion of the sheet upward, each side of the sheet is pulled around the guides 36, 37 and the remaining portion of the sheet. As shown in FIG. 3, a fold guide 39 is positioned at the forward end of the table top opening 12 and is retained at the same distance above the table 5 as the upward movement of the folding mechanism 1 by supports 40 which are in turn secured to the top of table 5. The guide rods 36 and 37 and fold guide 39 extend the length of the fold machine to control the sheet at the top and bottom of each fold.

Each sheet 13 is fed onto the table 5 in the direction shown by arrow 14 by dogs 41 which contact the rear edge of the sheet. The dogs are secured to a conventional chain drive which extends beneath and at each side of the table top 5 to a point approximately at the forward end of opening 12. Dogs 41 are spaced on the chain drive at a distance greater than the width of each sheet so that the sheets are fed onto table 5 and into the folding mechanism one after the other.

FIG. 3 illustrates the folding mechanism and operation that takes place at station I. A sheet 13 is fed onto the table and as it passes through opening 12 the folding mechanism moves in its elliptical path and wire 6 contacts the sheet and raises it and at the same time pulls the sheet around guide rods 36, 37. As the folding mechanism reaches the uppermost limit of its elliptical path a portion of the paper which is folded over wire 6 contacts the rollers 16 which are rotating rapidly at 2,000–3,000 revolutions per minute and the entire sheet is rapidly driven forward and the upper folded portion is driven onto fold guide 39. The forward movement of the sheet is so rapid that the contact of the sheet between rollers 16 and wire 6 and the driving of the upper fold portion of the sheet onto the fold guide 39 takes place during the small period of time that the folding mechanism 1 is at its uppermost reach in its elliptical path. The elliptical movement of the folding mechanism 1 and the movement of the sheet-feed dogs 41 are coordinated so that as a succeeding sheet 13 is fed onto the table top 5 and over opening 12 the folding mechanism 1 is again starting its upward movement through opening 12.

Station II is located adjacent to Station I and comprises two folding mechanisms 1′ which are identical to folding mechanism 1 and which are located one on each side of guide rods 36, 37 and fold guide 39. Each of these folding mechanisms has additional guide rods 36′, 37′ to complement guide rods 36, 37 but which start at Station II and extend to the end of the machine. Each folding mechanism 1′ also has its own fold guide 39′ which, like fold guide 39 at Station I, is positioned at the end of table opening 12 and extends from that point to the end of the machine. The folding mechanisms 1′ operate in tandem in the same manner as the folding mechanism 1 at Station 1. As the sheet is fed from Station II and into Station III it has 3 upwardly extending folds. Station III comprises two folding mechanisms 1″ which are identical to folding mechanism 1 and which are located one on each side of guide rods 36″, 37″ to complement guide rods 36′, 37′ but which start at Station III and extend to the end of the machine. Each folding mechanism 1″ has its own fold guide 39″ which like fold guides 39 and 39′ is positioned at the end of its table opening 12 and extends from that point to the end of the machine. Throughout its passage through the folder the folds in the sheet 13 are maintained by the guide rods 36, 37, 36′, 37′, 36″, and 37″ and by the fold guides 39, 39′ and 39″. As the folded sheet is fed from Station III it is fed off the guide rods and fold guides and between a pair of conventional vertically-extending rollers 51 which compress the folds further and allow the folded sheet to lie flat on the table surface. At that point the folded sheet can be removed or, if desired, the same folding mechanism can be used to fold the folded sheet at right angles to the original folds at a Station IV.

It is to be understood that the guide rods 36, 37 and fold guide 39 at each station can be adjusted for various paper thicknesses and widths of folds. The speed of elliptical movement of the folding mechanism and the rotational speed of co-operating rollers 16 can be adjusted for the type and weight of paper being folded. It may also be desirable, under some operating conditions, to provide added feeding rollers 50 which co-operate with the fold guide 39 to assist in moving the sheet from one station to the next. Other adjustments of parts and speeds of operation may be made to accommodate the type of material being folded without departing from the spirit and scope of the invention. Additionally at the end of Station III sheet metal elements may be provided at each side of the folding mechanism to guide the leading edge of the folded sheet into the rollers 51. After the folded sheet has been folded at Station IV glue may be applied to one folded edge for perfect binding. If desired a plurality of sheets which have been folded at Station IV may be grouped together and glue applied to one edge for perfect binding. It has been found that when the disclosed folding method is utilized and the folded sheets perfect bound, a paper saving of as much as 8 percent can be achieved.

I claim:

1. An apparatus for folding a sheet of paper comprising a table surface for receiving a flat sheet of paper, means for moving said sheet of paper across said table surface, an opening in said table, a first paper restraining means spaced above said table surface a distance sufficient to permit the passage of said sheet between it and said table surface and positioned at each side of said table opening, second paper restraining means spaced above said table a distance equal to the length of a fold in said sheet of paper positioned at the forward end of and in alignment with the center of said table opening, a sheet folding mechanism comprising a closed loop flexible member extending about a pair of spaced apart pulleys each of which is eccentrically mounted, means driving said pulleys whereby the upper reach of the flexible member rises and falls while remaining parallel to the surface of the table, rotatable sheet ejecting means positioned above said sheet folding mechanism to contact said folded sheet of paper when the flexible member reaches its uppermost movement to drive the folded portion of said sheet onto said second paper restraining means.

2. Apparatus for folding a sheet of paper as defined in claim 1 wherein a plurality of said folding mechanisms and said paper restraining mechanisms are arranged to sequentially form multiple folds in a sheet of paper as it moves across said table.

3. Apparatus for folding a sheet of paper as defined in claim 1 wherein means are provided on said pulleys to permit the flexible member to be driven about said pulleys by said sheet ejecting means.

4. Apparatus for folding a sheet of paper as defined in claim 3 wherein said means on each pulley comprises a ring surrounding the periphery of the pulley, a plurality of roller bearings positioned between the peripheral surface of the pulley and the inner surface of the ring, and the outer surface of the ring having a flexible loop receiving surface.

5. Apparatus for folding a sheet of paper as defined in claim 1 wherein said sheet ejecting means comprises a plurality of rollers each of which has its outer periphery formed into outwardly extending legs.

6. Apparatus for folding a sheet of paper as defined in claim 1 wherein said sheet ejecting rollers are driven at a speed of 2000–3000 revolutions per minute.

* * * * *